United States Patent [19]

Viot et al.

[11] Patent Number: 4,665,595

[45] Date of Patent: May 19, 1987

[54] CLASP WITH INTERCHANGEABLE ORNAMENT

[76] Inventors: Jean Viot, 9, rue St-Vincent de Paul, 22000 Saint-Brieuc; Daniel Piat, 36, Avenue Thierry, 92410 Ville d'Avray; Alain Duclos, 9, Cité Medicis, 78100 St-Germain-en-Laye; Simone V. Albert, 5, rue des Haudriettes, 75003 Paris, all of France

[21] Appl. No.: 725,090

[22] Filed: Apr. 19, 1985

[30] Foreign Application Priority Data

Apr. 20, 1984 [FR] France ..... 84 06334

[51] Int. Cl.[4] ..... A44B 11/25

[52] U.S. Cl. ..... 24/616; 24/573; 24/697; 63/2

[58] Field of Search ..... 24/573, 614–616, 24/625, 662, 681, 700, 697, 605; 63/DIG. 2, 2–4

[56] References Cited

U.S. PATENT DOCUMENTS

| | | | |
|---|---|---|---|
| 232,814 | 10/1880 | Granberry | 63/2 X |
| 1,169,693 | 1/1916 | Swedlund | 24/573 |
| 1,269,411 | 6/1918 | Edwards | 24/625 X |
| 1,396,887 | 11/1921 | Schroetter . | |
| 1,448,465 | 3/1923 | Sherman | 63/3 |
| 1,504,761 | 8/1924 | Hubbell . | |
| 2,266,074 | 12/1941 | Rauer | 24/616 |
| 2,539,777 | 1/1951 | Grassmann, Sr. . | |
| 3,066,501 | 12/1962 | Charles et al. | 63/2 |
| 3,357,204 | 12/1967 | Davis | 63/4 X |
| 3,360,836 | 1/1968 | Geldwerth | 24/616 |
| 3,421,341 | 1/1969 | Hodge . | |
| 3,462,807 | 8/1969 | Marquardt | 24/616 |
| 3,543,356 | 12/1970 | Zimmermann . | |
| 4,486,925 | 12/1984 | Lineberry | 24/616 X |
| 4,559,679 | 12/1985 | Downey | 24/615 |

FOREIGN PATENT DOCUMENTS

| | | | |
|---|---|---|---|
| 1191606 | 10/1959 | France | 24/662 |
| 793249 | 4/1958 | United Kingdom . | |
| 921790 | 3/1963 | United Kingdom | 24/662 |

*Primary Examiner*—Kenneth J. Dorner
*Assistant Examiner*—James R. Brittain
*Attorney, Agent, or Firm*—Ostrolenk, Faber, Gerb & Soffen

[57] ABSTRACT

A clasp with an interchangeable ornament includes a generally solid male clasp piece which is split longitudinally in a manner that it is transversely resilient, like a clip. A hollow female clasp piece has an insertion opening and an inwardly indented shoulder or lip at the insertion opening. When the male clasp piece is inserted into the female piece the shoulder of the female piece locks into a groove formed in the male clasp piece. Longitudinally extending slits in the peripheral wall of the female piece makes it transversely elastic and enables it to tightly hold an interchangeable ornamental sleeve that is fitted over the female piece. The ornamental sleeve in turn prevents the slit peripheral wall of the female piece from separating and assures that the inwardly indented shoulder remains locked in the groove of the male piece. Therefore, the male clasp part can not be a pulled out, except by squeezing the male piece to reduce its transverse cross-section to be smaller than the cross-section of the female piece.

12 Claims, 12 Drawing Figures

Figures 1, 2, 3, 4, 5, 6:
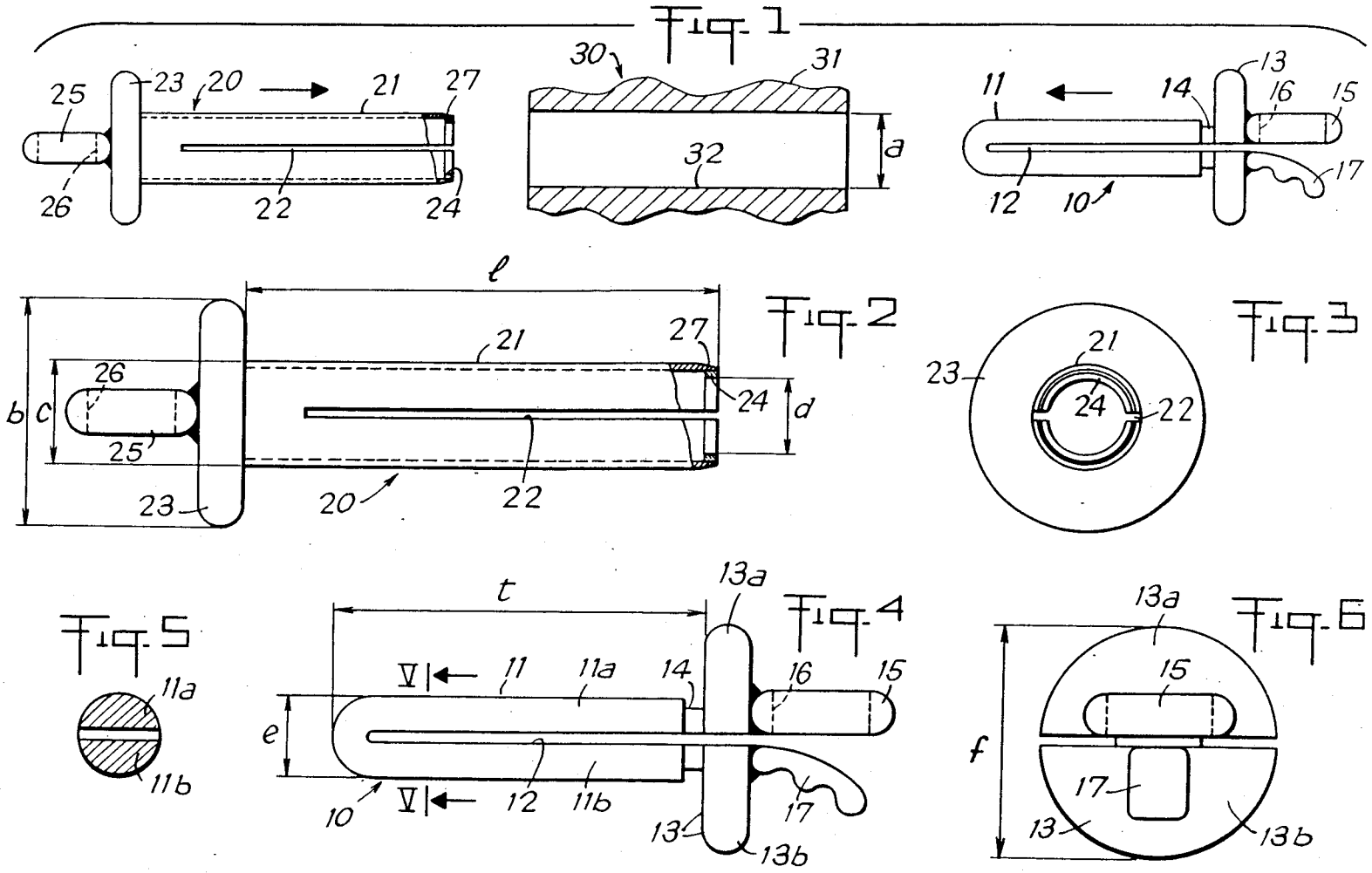

Fig. 7
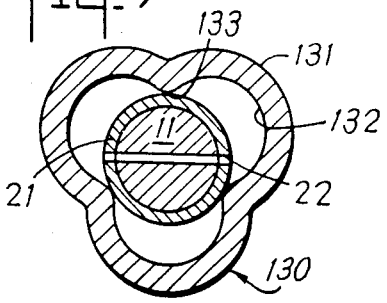
Fig. 8
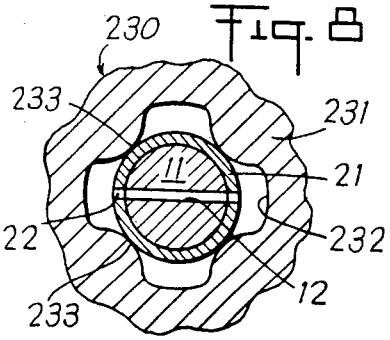
Fig. 9
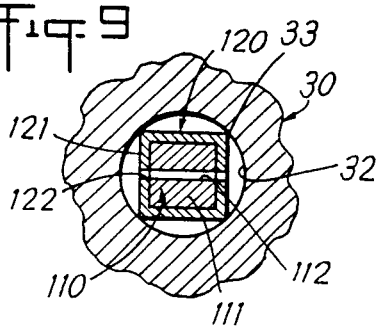
Fig. 10
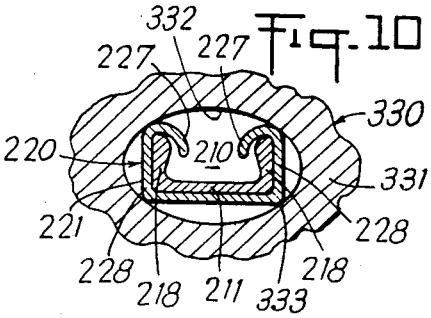
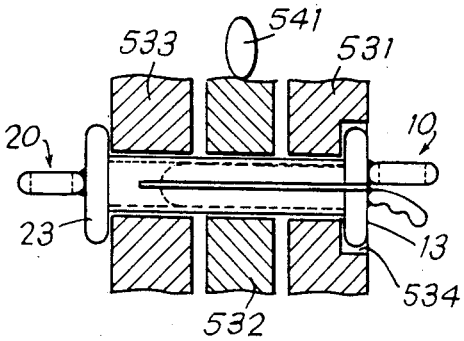
Fig. 11
Fig. 12
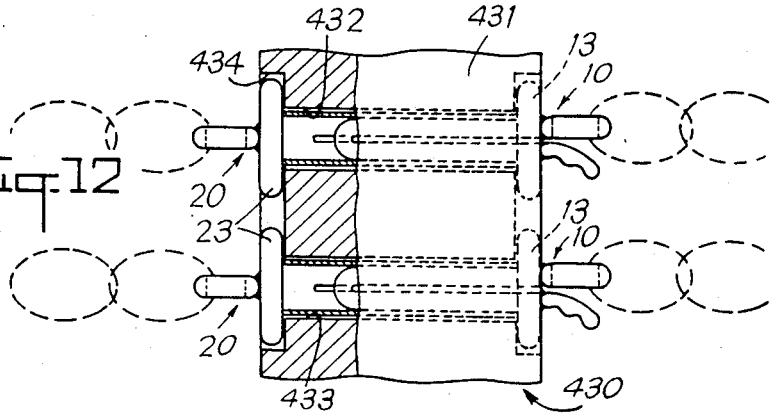

CLASP WITH INTERCHANGEABLE ORNAMENT

The present invention relates to a clasp with interchangeable ornament, comprising a first male coupling part having elasticity in the transverse direction and provided with stopping elements, and a second female coupling part intended to accommodate the first coupling part and to be fastened selectively to the latter.

A clasp of this type is used especially in jewelry and more particularly for the closure of pre-strung necklaces, in which case the female coupling part which fits over the male coupling part is generally provided with a particular ornamentation. A major disadvantage of this type of clasp associated, for example, with a pre-strung necklace, or with any other fashion article requiring a closure, is the fact that a purchaser, although attracted by one part of the proposed article, for example the beads of a necklace, does not necessarily aopreciate the ornamental design of the clasp. Conversely, a customer may appreciate the ornamentation of a particular clasp without liking the beads of the associated strung necklace. This results in lengthy operations to dismantle and reassemble the articles in order to combine a particular clasp having a specific ornamentation with an ornamental article itself having a particular ornamental character.

These clasp dismantling and reassembling operations require time and often prevent the customer from immediately taking away the desired article fitted with a clasp whose ornamentation is to his/her liking. Furthermore, if the ornamental design of the clasp should subsequently cease to appeal to the wearer, choosing a new ornamental design capable of being fitted to the same article requires the purchase of a complete new clasp, which, especially in the case of articles of jewelry made of precious metals, may prove expensive and also entails an operation on the article in question to dismantle and reassemble the coupling parts of the clasp, which can rarely be done straightaway.

The aim of the present invention is precisely to overcome the abovementioned disadvantages and to offer a wearer the possibility of choosing the ornamental design of a clasp for an article and modifying it at will without necessitating lengthy and complex operations on the article to dismantle and reassemble the clasp. Thus, the aim of the invention is more particularly to enable the ornamentation of the clasp of an article to be modified quickly and economically while this clasp is still fitted to the article.

These objects are achieved by means of a clasp of the type mentioned at the beginning of the description, in which, according to the invention, the second female coupling part also has elasticity in the transverse direction and a detachable ornamental sleeve is engaged around the said second female part in order to ensure that the locking mechanism of the first male part is held inside the second female part.

Preferably, the first and second coupling parts are cylindrical, as is the bore of the detachable ornamental sleeve.

In one particular embodiment, the second coupling part comprises a hollow cylindrical portion split along at least one generatrix in order to create elasticity in the transverse direction, and the first coupling part comprises a solid cylindrical portion split in a longitudinal plane.

The stopping means formed on the first coupling part can consist of a groove interacting with a shoulder produced on the second coupling part.

According to one particular characteristic, the first and second coupling parts each comprise a bearing ring serving to retain the detachable sleeve.

In a first embodiment of the invention, the sleeve has a bore whose cross-section has the same shape and substantially the same dimensions as the cross-section of the second coupling part.

In a second possible embodiment, the sleeve has a bore whose cross-section is larger than that of the second coupling part and whose shape is different from that of the latter, so that it only bears on the female part along a limited number of generatrices.

The present invention permits to the construction of a multiple clasp comprising several pairs of male and female coupling parts and a single sleeve having several bores, each of which is intended to accommodate a female coupling part.

The invention is applicable to all fashion articles such as, in particular, necklaces, bracelets, pieces of jewelry, handbags or belts.

Further characteristics and advantages of the invention will become apparent from the following description of particular embodiments, which are given as examples with reference to the attached drawings; in these drawings:

FIG. 1 is an exploded view of a clasp according to the invention,

FIGS. 2 and 3 are a front view and a right view of the female coupling part of the clasp of FIG. 1, FIGS. 4, 5 and 6 are, respectively, a front view, a cross-section along the line V—V of FIG. 4 and a right view of the male coupling part of the clasp of FIG. 1, FIGS. 7 to 10 are cross-sections, in a plane perpendicular to the axis of the clasp, of various alternative embodiments of the coupling parts and the detachable sleeve of the clasp according to the invention, and FIGS. 11 and 12 are front views of two other embodiments of the clasp.

FIG. 1 shows, in the exploded position, an example of a clasp according to the invention, comprising a first male coupling part 10, a detachable ornamental sleeve 30 having a bore 32 of cross-section a and an ornamental outer surface 31, and a second female coupling part 20.

The sleeve 30 has a bore 32 of cylindrical shape and an outer surface 31 which can have a very wide variety of shapes and appearances. In particular, ornamental elements, such as precious or semi-precious stones, for example, can be attached to the outer surface 31 of the sleeve 30.

The sleeve 30 can be made of a base metal or precious metal and can be manufactured for example by die stamping-cutting-slicing on a lathe, or from molten metal, or by electroerosion. However, the sleeve 30 can also be made of any other natural or synthetic material which makes it possible to provide the sleeve with an ornamental appearance or to attach ornamental elements to the outer surface 31 of the sleeve. In general, however, the sleeve must be made of a rigid material which makes it possible to produce a bore 32 having virtually no elasticity in the transverse direction.

The sleeve 30 is intended to fit over the cylindrical body 21 of the female coupling part 20 and to butt against the stop bearing 23 to which a ring 25 is attached for connection to one end of the article to be fitted with the clasp.

The cylindrical body 21 of the female part 20 also has elasticity in the transverse direction so as to anable this body 21 to be inserted easily into the bore 32 of the sleeve 30.

The male coupling part 10, which is made in the form of a clip, itself has a cylindrical body 11 with elasticity in the transverse direction so as to enable this body 11 to be inserted into the hollow cylindrical body 21 of the female part 20 surrounded by the detachable sleeve 30. A bearing 13, formed at that end of the cylindrical body 11 which does not engage with the hollow body 21, makes it possible totally to immobilize the sleeve 30, which is trapped between the bearings 13 and 23 of the two coupling parts 10, 20. In the closed position of the clasp, by virtue of the elasticity of the body 11 of the male part 10 forming a clip, locking means 14 formed on the male part 10 in the vicinity of the bearing 13 interact with complementary locking means 24 produced at the free end of the body 21 of the female part 20, in order to prevent any separation of the various constituent elements of the clasp.

If FIGS. 2 and 3 are considered more particularly, it is seen that there is a female part 20 having a hollow cylindrical body 21 provided, along at least one longitudinally extending lines on its peripheral surface and preferably along at least two diametrically opposite such lines located in the same axial plane, with a slit 22 whose length is less than the total length l of the body 21 and whose width is small, for example a few tenths of a millimeter. This median longitudinal slit, causing a separation of a few hundredths of a millimeter,, provides elasticity and makes it possible to immobilize the sleeve 30 when it is pushed over the cylindrical body 21 of the female part 20. At the non-split end of its elongate body 21, the female part 20 has a bearing 23 which can have a very wide variety of shapes but is made for example in the form of a ring or disc concentric with the body 21 and of cross-section b greater than the cross-section a of the bore of the sleeve 30. A ring 25, provided with a central opening 26, is attached to the bearing 23 to enable the end of a necklace (not shown), for example, to be fixed thereto.

It will be noted that the diameter c of the cylindrical body 21 must remain practically constant over the whole length l of the body 21 and have a separation of the order of only a few hundredths of a millimeter at its split end. In the non-split portion of the body 21, the diameter c of the cylindrical body essentially corresponds to the diameter a of the bore 32 of the sleeve 30 and is only less than the latter by the value of the play necessary for circulation of the sleeve 30 over the body 21 of the female part 20. At its split free end, the female part 20 advantageously has an external chamfer 27 which facilitates the introduction of the sleeve 30.

Inside the hollow cylindrical body 21 of the female part 20, at the split free end, a shoulder or stop ring 24 is produced around the inner periphery of the cylindrical body 21 so as to lock into a corresponding groove 14 made in the male coupling part 10. The female coupling part 20 can be made of metal or any other material making it possible to provide the body 21 with rigidity in the axial direction and elasticity in the radial direction, either by the very nature of the material or by the production of longitudinal notches 22.

FIGS. 4 to 6 show in greater detail the configuration of an example of a male coupling part 10 matching the part 20 of FIGS. 2 and 3. In this embodiment, the male part 10 comprises a cylindrical body 11 consisting of a wire of semicircular section, bent double and attached at its rear end to a bearing 13 having a cross-section of diameter f greater than the diameter a of the bore 32 of the sleeve 30. The bearing 13 actually consists of two parts 13*a*, 13*b* located in the same radial plane, relative to the body 11, and attached respectively to the upper part 11*a* of the body 11 and the lower part 11*b* of the body 11, which are separated by a slit 12 having a small width of the order of a few tenths of a millimeter.

A ring 15 provided with an opening 16 is fixed to one of the half-bearings 13*a*, 13*b*, for example to the upper half-bearing 13*a*, and is used for the fixing of one end of the article to be fitted with a clasp. A tongue-shaped part 17 can also be fixed to the lower half-bearing 13*b* in order to facilitate the handling of the male part 10 in the form of a clip. A pressure applied simultaneously to the ring 15 and to the tongue 17 makes it possible to squeeze the clip and bring together the upper and lower parts 11*a*, 11*b* of the body 11, thus at least partially closing the slit 12. It will be noted, however, that the tongue 17 is not essential and that the part 10 can be gripped and squeezed by the two half-bearings 13*a*, 13*b*.

An annular groove 14 is made in the body 11, in the immediate vicinity of the bearing 13, so as to form a locking element interacting with the ring 24 inside the female part 20. The cross-section and depth of the groove 14 are slightly greater than those of the stop ring 24 of the part 20. Complementary locking means, equivalent to the combination of stop ring 24 and groove 14, could of course be substituted on the parts 10 and 20.

The diameter e of the cylindrical body 11 is less than the internal diameter d of the stop ring 24 of the part 20 by the value of the play necessary for circulation of the part 10 in the part 20. By virtue of the presence of the slit 12 separating the lower arm 11*b* and upper arm 11*a* of the clip 10, the clip 10 is elastic and, when no manual pressure is being exerted on the two half-bearings 13*a*, 13*b* or gripping elements fastened to these two half-bearings, the stop ring 24 remains securely engaged in the groove 14 on account of the fact that the two parts 11*a* and 11*b* of the clip 10 tend to move apart. Of course, the length t of the cylindrical body 11 is slightly less than the length l of the cylindrical body 21. Like the part 20, the coupling part 10 can be made of metal or another suitable material which, by its nature or by the configuration of the cylindrical body 11, makes it possible to provide the part 10 with rigidity in the axial direction and elasticity in the radial direction.

The embodiment of FIGS. 1 to 6 shows a sleeve bore 32, a body 21 of the female part 20 and a body 11 of the male part 10, the said bore and bodies being cylindrical and of circular cross-section. Various other configurations may be envisaged for the cross-section of the cylindrical elements formed by the bore 32, the body 21 and the body 11, for example square, oval or rectangular shapes. Furthermore, although the cross-sections of the cylindrical bodies 11 and 21 of the parts 10 and 20 preferably have the same shape, the bore 32 of the sleeve 30 may itself have a different shape from that of the body 21 of the female part 20 and only bear on the latter at a limited number of contact areas.

FIGS. 7 to 10 show a few examples of different configurations from that of FIGS. 1 to 6, in which the cross-section of the bore 32 or of the cylindrical bodies 11, 21 is not circular.

FIGS. 7 and 8 show clasps in which the coupling parts 10, 20 correspond to the embodiment of FIGS. 1 to 6, i.e. they have bodies 11, 21 of circular cross-section, but the sleeve 130, 230 has a noncircular bore 132, 232 which has a greater cross-section than the body 21 of the female part 20 and only bears on the latter along three or four contact areas or lines 133, 233 respectively. The outer contour 131, 231 of the sleeves 130, 230 can have any shape.

FIG. 9 shows a clasp in which the sleeve 30 corresponds to the embodiment of FIG. 1 and has a bore 32 of circular cross-section. However, the bodies 111, 121 of the matching male part 110 and female part 120, which are split with openings 112, 122, themselves have a square cross-section and the body 121 of the female part 120 bears on the bore 32 along four contact regions 33.

FIG. 10 shows yet another possible form of clasp with an ornamental sleeve 330 having a bore 332 of oval cross-section, interacting with a body 221 of the female coupling part 220, whose cross-section is inscribed inside a rectangle and which bears on the bore 332 along four generatrices 333. In the embodiment of FIG. 10, the coupling parts 210 and 220 have bodies 211, 221 of U-shaped cross-section. Thus, the body 211 of the male part 210 comprises a flat portion, forming a base, which is joined to two longitudinal flanges 218 having a degree of flexibility in the transverse direction. The body 211 is itself engaged in the body 221 of the female part 220, which is similarly composed of a flat base portion and two longitudinal flanges 228 enclosing the longitudinal flanges 218 and capable of having flexible curved portions 227 which bend inwards to overlap the longitudinal flanges 218 of the body 211. This embodiment of the coupling parts 210, 220 could of course also be adapted to suit sleeves 330 having bores 332 of a different shape, for example a rectangular shape.

The present invention, the aim of which is essentially to enable clasps of a variety of appearances to be constructed from the same standard type of basic closure mechanism, is able to have a large number of alternative embodiments. Thus, the sleeve 30 intended to be pushed over the coupling part 20 can consist of several aligned coaxial sleeve sections arranged successively on the cylindrical body 21.

FIG. 11 thus shows another embodiment in which a clasp comprises a sleeve in several parts 531, 532, 533 of non-identical shapes, one of which can carry a pendant 541, the said sleeve accommodating a pair of complementary parts 10, 20 similar, for example, to the parts of FIGS. 1 to 6, and the said pair being intended to provide the closure for a row of necklace beads, for example. As can be seen in FIG. 11, one part of the sleeve may extend beyond the bearings 13, 23 of the parts 10, 20, in which case the said bearings are set in a space 534 covered by the outer surface of the part 531.

FIG. 12 shows yet another embodiment in which the same clasp comprises a single sleeve 430 provided with several bores 432, each accommodating a pair of complementary coupling parts 10, 20 similar, for example, to the parts of FIGS. 1 to 6, each pair being intended to provide the closure for a row of necklace beads, for example. As can be seen in FIG. 12, the sleeve may extend beyond the bearings 13, 23 of the parts 10, 20, in which case the said bearings are set in a space 434 covered by the outer surface 431 of the sleeve 430.

What is claimed is:

1. A clasp with an interchangeable ornament, comprising:

a rigid, detachable, and exteriorly ornate sleeve having an elongate bore therethrough;

an elongated female clasp portion having a longitudinally extending bore and a peripheral wall around the longitudinally extending bore, at least one longitudinally extending slit in the peripheral wall formed in a manner which is effective to make the female clasp resilient in a direction transverse to its longitudinal direction, a first bearing located at a first longitudinal end of the female clasp portion and an inwardly directed shoulder formed at the opposite longitudinal end of the female clasp; and a generally solid elongated male clasp portion intended to be inserted into the female clasp portion, the male clasp portion having a longitudinally extending split which extends from a first longitudinal end thereof toward the opposite longitudinal end thereof and which permits deformation in a direction transverse to the longitudinal direction, a second bearing located at the first longitudinal end, and a groove in the exterior surface of the male clasp adjacent the second bearing;

said sleeve and said female clasp being resiliently engageable with one another in consequence of said female clasp's transverse resiliency, said male clasp being detachably insertable in said female clasp such that said shoulder of said female clasp engages said groove of said male clasp and said sleeve prevents said female clasp from expanding transversely thereby restraining said male clasp from disengagement with said female clasp except when the male clasp is deformed.

2. The clasp as claimed in claim 1, wherein a transverse cross-section of the bore in the sleeve has the same shape and substantially the same dimensions as the cross-section (c) of the female clasp portion.

3. The clasp as claimed in claim 1, wherein a transverse cross-section of the bore in the sleeve is larger thatn that of the female clasp portion and the sleeve contacts the female clasp portion along several predetermined contact regions.

4. The clasp as claimed in claim 1, wherein the male clasp portion is in the shape of a clip.

5. The clasp as claimed in claim 1, wherein the female and male clasp portions include a respective ring located, respectively, adjacent the first and second bearings for attaching a chain to the clasp.

6. The clasp as claimed in claim 1, wherein the detachable sleeve (30) includes ornamental elements attached to its outer surface.

7. The clasp as claimed in claim 1, wherein the detachable sleeve is formed of several parts (531, 532, 533).

8. A clasp as claimed in claim 1, in which the male and female clasp portions are comprised of several pairs of male and female. coupling parts (10, 20) and the sleeve comprises several bores so disposed that each bore in the sleeve accommodates a respective female coupling part.

9. The clasp as claimed in claim 1, in combination with a fashion article such as a necklace, bracelet, piece of jewelry, handbag or belt.

10. The clasp of claim 1 in which the female clasp, the male clasp, and the sleeve have a circular cross-section.

11. The clasp of claim 1 in which the male and female clasp portions are comprised of metallic material.

12. The clasp of claim 1 in which the male clasp portion comprises an upper part and a lower part which extend longitudinally and which are separated by a distance of a few tenths of a millimeter, the separation being constituted of said split, the upper part and the lower part being linked at the opposite longitudinal end of the male clasp, the bearing of the male clasp being comprised of first and second bearing halves which are located in one radial plane and which are respectively attached to the upper and lower parts.

* * * * *